US006619931B2

(12) United States Patent
Anderson

(10) Patent No.: US 6,619,931 B2
(45) Date of Patent: Sep. 16, 2003

(54) BLADDER PUMP FOR LIQUID SAMPLING AND COLLECTING

(76) Inventor: Brian Anderson, 7353 Cedar Crest Dr., Sauk City, WI (US) 53583

( * ) Notice: Subject to any disclaimer, the term of this patent is extended or adjusted under 35 U.S.C. 154(b) by 0 days.

(21) Appl. No.: 10/139,647

(22) Filed: May 7, 2002

(65) Prior Publication Data

US 2002/0172600 A1 Nov. 21, 2002

Related U.S. Application Data

(63) Continuation-in-part of application No. 09/512,295, filed on Feb. 24, 2000, now Pat. No. 6,382,933.

(51) Int. Cl.[7] ..... F04B 43/08
(52) U.S. Cl. ..... 417/394; 417/478
(58) Field of Search ..... 137/533; 417/394, 417/478

(56) References Cited

U.S. PATENT DOCUMENTS 1,043,279 A * 11/1912 Wheeler ..... 137/533
1,352,306 A * 9/1920 Mott ..... 417/478
1,976,415 A * 10/1934 Scott ..... 417/478
2,046,491 A * 7/1936 Scott ..... 417/478
2,196,993 A * 4/1940 Kidder ..... 417/394
2,626,569 A * 1/1953 Knudson ..... 417/394
4,008,008 A * 2/1977 Vergnet ..... 417/385
4,111,613 A * 9/1978 Sperry ..... 417/394
4,585,060 A * 4/1986 Bernardin et al. ..... 417/394
4,674,959 A * 6/1987 Fox et al. ..... 417/394
4,701,107 A * 10/1987 Dickinson et al. ..... 417/478
4,810,172 A * 3/1989 Fiedler et al. ..... 417/394
4,886,432 A * 12/1989 Kimberlin ..... 417/478
5,027,902 A * 7/1991 Dickinson et al. ..... 417/394
5,028,213 A * 7/1991 Dickinson et al. ..... 417/478
5,058,669 A * 10/1991 Wells ..... 417/478
5,147,182 A * 9/1992 Timmons ..... 417/394
5,147,184 A * 9/1992 Newcomer et al. ..... 417/394
5,147,185 A * 9/1992 Niehaus et al. ..... 417/394
RE34,754 E * 10/1994 Dickinson et al. ..... 417/394
5,704,772 A * 1/1998 Breslin ..... 417/478

* cited by examiner

*Primary Examiner*—Michael Koczo
(74) *Attorney, Agent, or Firm*—Liniak, Berenato & White, LLC

(57) ABSTRACT

A liquid pump for pumping groundwater samples from small diameter sub-terrain wells, comprising a tubular casing having inlet apertures, a top cap provided with a fluid communication port and a liquid outlet port, a top bladder mandrel secured to the top cap, a mandrel sealing member disposed in a lower end of the casing, a bottom bladder mandrel secured to the mandrel sealing member, and a flexible bladder extending between the top bladder mandrel and the bottom bladder mandrel and defining a liquid chamber for receiving the liquid therein and a fluid chamber for receiving a fluid under pressure therein that surrounds the liquid chamber, with the bladder disposed therebetween. The fluid chamber is in fluid communication with the fluid communication port connected to a source of the actuating gas, while the liquid chamber is in one-way fluid communication with the liquid inlet and the liquid outlet port.

27 Claims, 5 Drawing Sheets

BLADDER PUMP FOR LIQUID SAMPLING AND COLLECTING

RELATED APPLICATIONS

This is a continuation-in-part of U.S. application Ser. No. 09/512,295, filed Feb. 24, 2000, U.S. Pat. No. 6,382,933.

BACKGROUND OF THE INVENTION

1. Field of the Invention

The present invention relates generally to liquid pumping and collecting apparatuses, and more particularly to a bladder pump for pumping underground liquid, such as groundwater samples, from small diameter wells. It should be noted, however, that the invention is also applicable and adaptable in various other applications that will occur to one skilled in the art from the disclosure herein.

2. Description of the Prior Art

Recent increases in public concern for the environment have resulted in various government-imposed environmental regulations with regard to groundwater quality and land-site cleanup projects. Among such regulations are requirements relating to the monitoring and sampling of water quality of aquifers as sources of drinking water. In response to these requirements, water quality analytic capabilities have been improved and water-sampling equipment has been developed. However, presently most sampling using bladder pumps employ permanently installed dedicated pumps in monitoring wells. Current portable equipment for the groundwater sampling is relatively heavy, bulky, and thus difficult to transport from one monitoring site to another.

One of the preferred types of pumps for groundwater sampling or other pumping applications is a submersible, fluid-actuated pump wherein the actuating fluid is preferably a gas such as compressed air. A flexible bladder member in this type of pump separates and isolates the interior of the pump into two chambers: a liquid chamber that contains the sample fluid and is in communication with both the pump inlet and outlet, and a gas chamber surrounding the first chamber, and connected to a source of the actuating gas, with the bladder disposed therebetween. The pumped liquid is conveyed through the pump by alternately pressurizing and venting or relieving the pressure in the gas chamber to contract and relax the bladder member, thus alternately decreasing and increasing the volume of the liquid chamber. The pumped liquid is drawn into the liquid chamber during such increases in volume under the influence of the natural hydrostatic head of the groundwater or other pumped liquids and is discharged through the pump outlet during such decreases in volume, thereby conveying the pumped liquid through the pump.

The conventional bladder pumps have proven to be not very efficient, however, in obtaining consistent, non-contaminated water samples that are accurately representative of the water system from which the sample is taken. The inadequacies of previous sampling equipment stem largely from such causes as cross-contamination between sampling sites, ineffective and inconsistent field cleaning methods, contamination due to equipment handling, and inconsistent well depth sampling. In addition to presenting sample quality problems, much of the previous equipment has been heavy and bulky and thus difficult to transport from one monitoring site to another.

Moreover, conventional bladder pumps for groundwater sampling have proved to be complicated to operate, relatively expensive, and impractical for sampling at remote locations where site access is severely limited. The need therefore exists for more efficient and easy to operate liquid sampling bladder pumps.

SUMMARY OF THE INVENTION

The present invention alleviates the drawbacks of the prior art. The present invention provides a pump for a wide variety of applications, including, but not limited to, groundwater quality applications, withdrawing and collecting contaminated groundwater or other subterranean liquids from a landfill-site having a plurality of in-ground wells. The novel pump may be built with a small outside diameter, such as 1.315", and is adapted to sample temporarily and/or permanently installed small diameter monitoring wells. The bladder pump of the present invention is particularly effective for conducting "low-flow sampling" from monitoring wells where minimal purging is undertaken prior to sample collection. Please note that low-flow refers to the velocity with which water enters pump intake and that is imparted to the formation pore water in the immediate vicinity of the well screen.

The preferred liquid sampling pump is an air-operated, gas-displacement bladder pump having a generally tubular casing submersible in the in-ground well. The pump body includes a liquid inlet with an inlet check valve for allowing one-way fluid flow from the in-ground well into the housing interior, and a liquid outlet with an outlet check valve allowing one-way fluid flow from the pump body interior to the discharge collection equipment. The liquid sampling pump further includes a top cap attached to an upper end of the casing and provided with a fluid communication port and a liquid outlet port, a top bladder mandrel secured to the top cap, a mandrel sealing member disposed in a lower end of the casing and defining an inlet chamber within the lower end thereof, a bottom bladder mandrel secured to the mandrel sealing member, and a flexible bladder extending between the top bladder mandrel and the bottom bladder mandrel and defining a liquid chamber for receiving the liquid therein and a fluid chamber for receiving a fluid under pressure therein that surrounds the liquid chamber, with the bladder disposed therebetween. The fluid chamber is in fluid communication with the fluid communication port that is connected to a source of the actuating gas, while the liquid chamber is in one-way fluid communication with the liquid inlet and the liquid outlet port.

The sample fluid is conveyed through the pump by alternately pressurizing and venting or relieving the pressure in the second chamber to contract and relax the bladder member, thus alternately decreasing and increasing the volume of the first chamber. Sample liquid is drawn into the liquid chamber during such increases in volume under the influence of the natural hydrostatic head of the groundwater and is discharged through the liquid outlet port during such decreases in volume, thereby conveying the sample liquid through the pump. The components of the pump are preferably composed of low-cost, lightweight synthetic materials that are non-corrosive and do not otherwise affect the chemical composition of the sampled fluid.

Additional advantages and features of the present invention will become apparent from the following description and the appended claims taken in conjunction with the accompanying drawings.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

Figure 1:
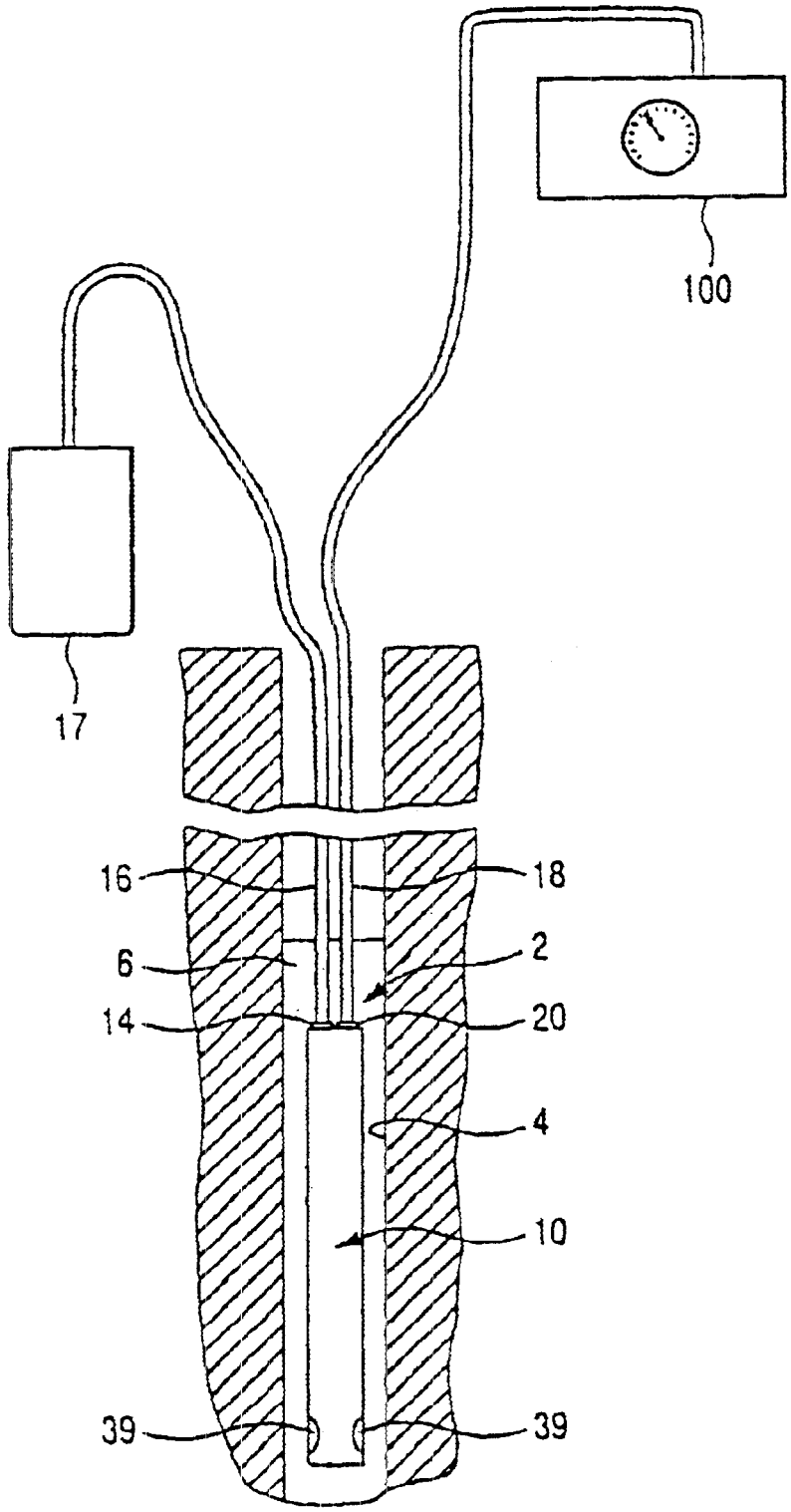
FIG. 1 is a fragmentary longitudinal sectional view of a liquid sampling system of the present invention.

FIG. 1 of the drawings illustrates an underground liquid sampling system of the present invention indicated generally by reference numeral 1. For purposes of illustration, the liquid sampling apparatus is shown as installed in a monitoring well 2. A liquid sampling pump 10 is disposed within the well casing 4 of the monitoring well 2 and is submerged beneath the level of the groundwater 6 to a suitable depth for obtaining representative groundwater samples.

As is explained in further detail below, the liquid sampling pump 10 in accordance with the present invention, is a bladder-type fluid-actuated pump, wherein the actuating fluid is a pressurized gas, preferably compressed air, and includes a plurality of inlet openings 39, an outlet fitting 14, and a fluid fitting 20.

A liquid conduit 16 is sealingly connected at one end to the pump outlet fitting 14 to provide direct sample delivery to a sample collection vessel 17. A pressurized gas conduit 18 is connected at one end to the fluid fitting 20 of the pump 10. The other end of the gas conduit 18 is selectively and removably connected to a precision dual range controller 100.

Because the pump is of a relatively lightweight construction, the conduits themselves can frequently be used to hold and retain the pump in its submerged position in the well 2. Preferably, the pump 10 is provided with a support rod 15 (shown in FIG. 3) that allows users to suspend the sampling pump 10 in the well 2 with a covered steel cable (not shown). It will be appreciated that any other appropriate means for holding and retaining the pump 10 in its submerged position in the well 2, commonly known to those skilled in the art, may be used.

The precision dual range controller 100 is selectively and removably connected to the sampling pump 10 by means of the external gas conduit 18. The preferred controller 100 is a portable, lightweight unit and includes means for alternately positively pressurizing and venting or relieving the pressure of the actuating gas in order to operate the liquid sampling pump 10, as is explained below.

Figure 2:
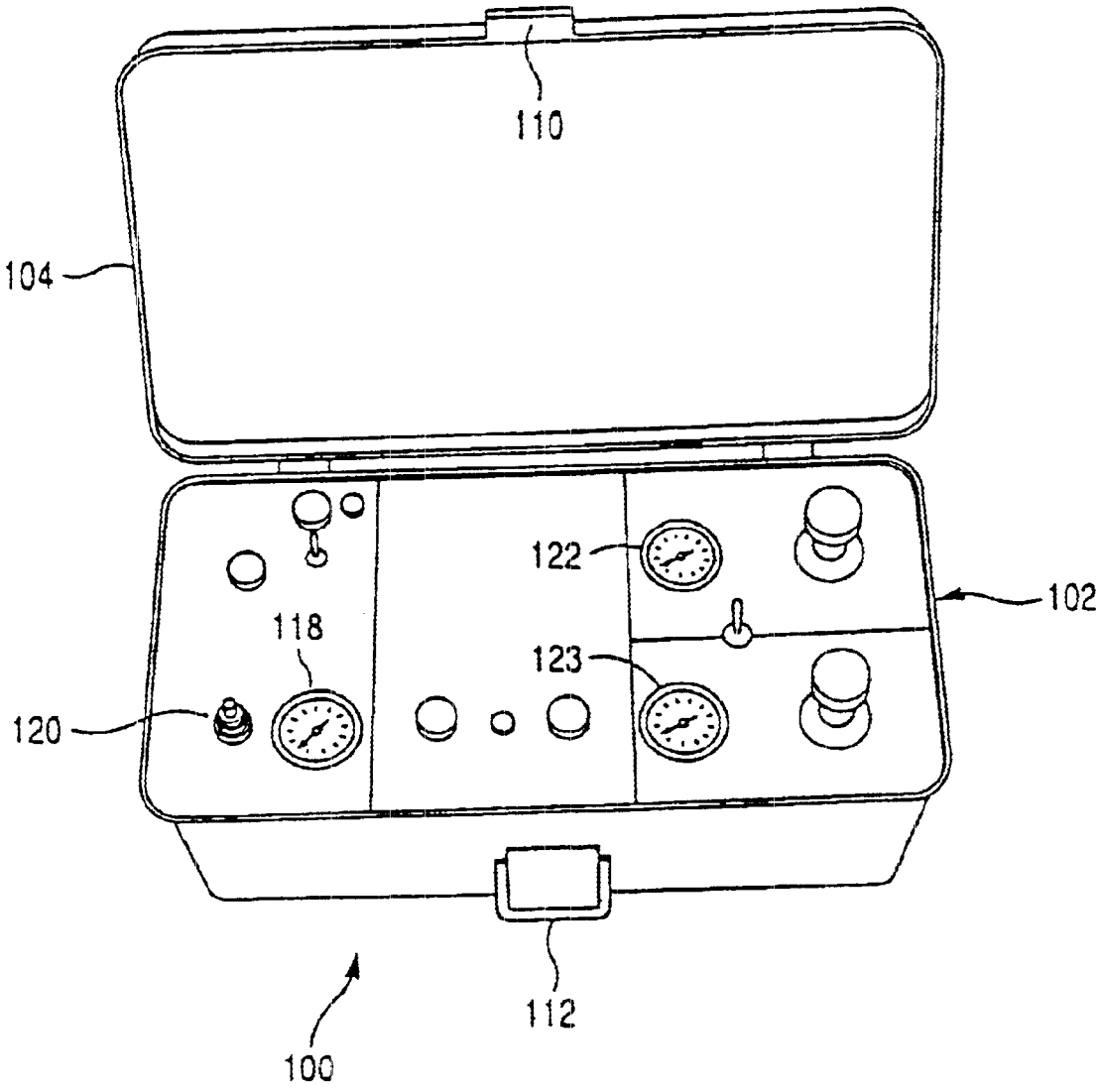
FIG. 2 is a perspective view of a controller apparatus of FIG. 1.

FIG. 2 illustrates a preferred physical arrangement for the dual range controller 100, including a carrying case 102 for housing and transporting the portable controller apparatus from one monitoring site to another. The carrying case 102 generally includes an upper portion 104 hingedly connected to a base portion 106, carrying handle (not shown), and upper and lower latches 110 and 112. The carrying case 102 is preferably composed of high impact-resistant materials known to those skilled in the art for purposes of protecting the components of the controller 100. The dual range controller generally includes two separate, switchable, pressure regulated air supply circuits, preferably 0–50 psi and 0–100 psi, each having a dedicated pressure gauge 122 and 123 respectively, a fitting 120 to which the external gas conduit may be connected, a pressure gauge 118 used to monitor the air supply provided to the controller 100, and various controls. To enable precision control of the flow from the bladder pump, the controller 100 is provided with separate precision electronic timers to control the flow air to and from the pump 10, each of which is adjustable in the range of 0.1 to 10 seconds. The carrying case 102 is especially adapted for ease and convenience of transportation of the controller and related components to monitoring sites to which access is limited or difficult.

The various individual components of the preferred controller apparatus 100 are well known to those skilled in the art and thus are described only schematically in terms of their functions.

Figure 3:
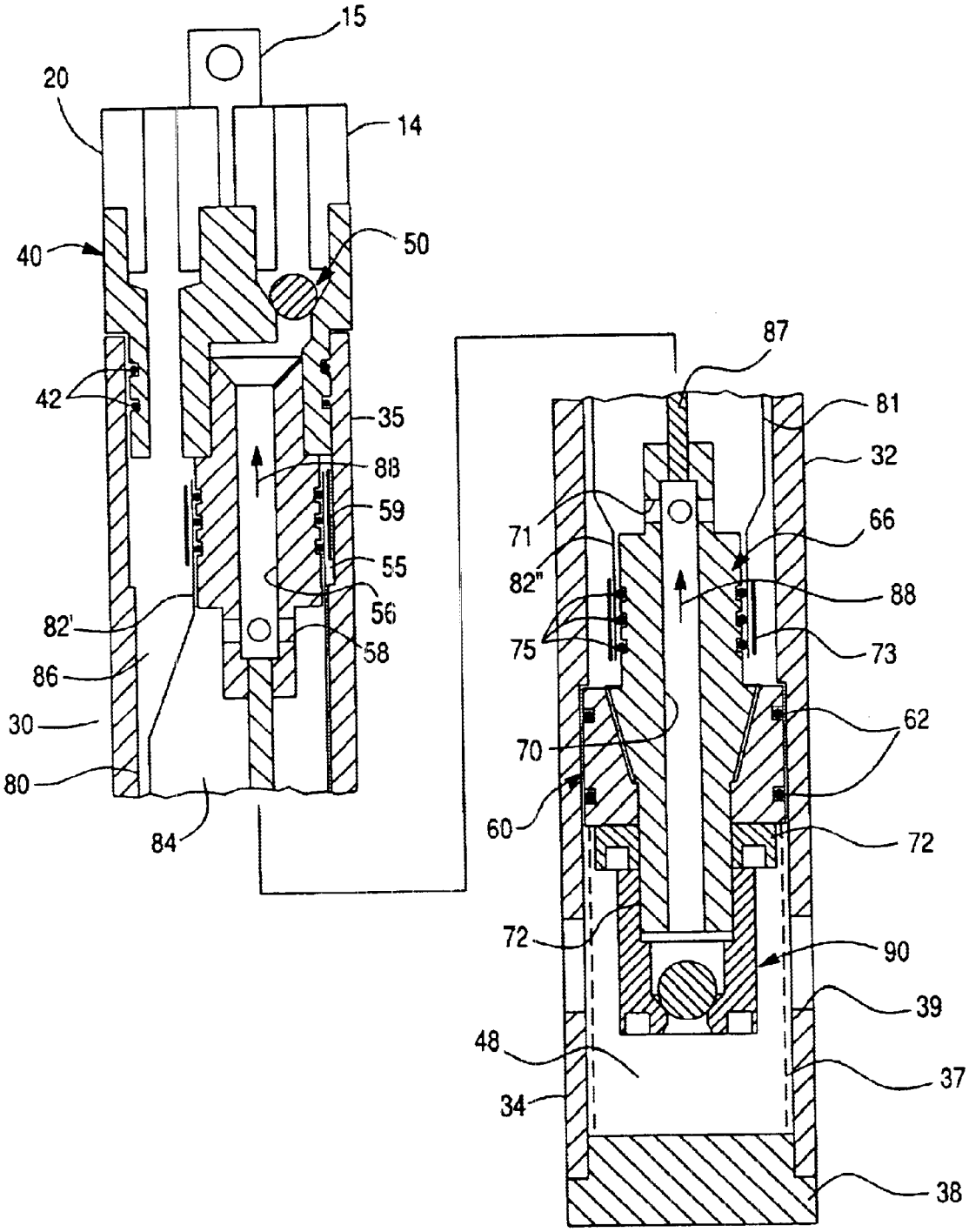
FIG. 3 is a fragmentary cross-sectional view of a liquid sampling pump in accordance with the preferred embodiment of the present invention.

As illustrated in FIG. 3, the liquid sampling pump 10 in accordance with the preferred embodiment of present invention includes a generally tubular pump casing 30 having a cylindrical wall 32, a lower end 34 and an upper end 35. The lower end 34 of the pump casing 30 is sealed with a bottom plug 38 press fitted or otherwise secured to the lower end 34 of the tubular pump casing 30 in any appropriate manner known to those skilled in the art. The bottom plug 38 may include an embedded weight in order to insure appropriate orientation of the sampling pump 10 within the well 2. The lower end 34 of the tubular casing 30 is further provided with at least one liquid inlet, preferably in the form of the circular inlet openings 39 in the wall 32. Preferably, the tubular pump casing 30 is provided with four inlet openings 39, however, any other appropriate number of openings 39 is within the scope of the present invention.

Figure 4:
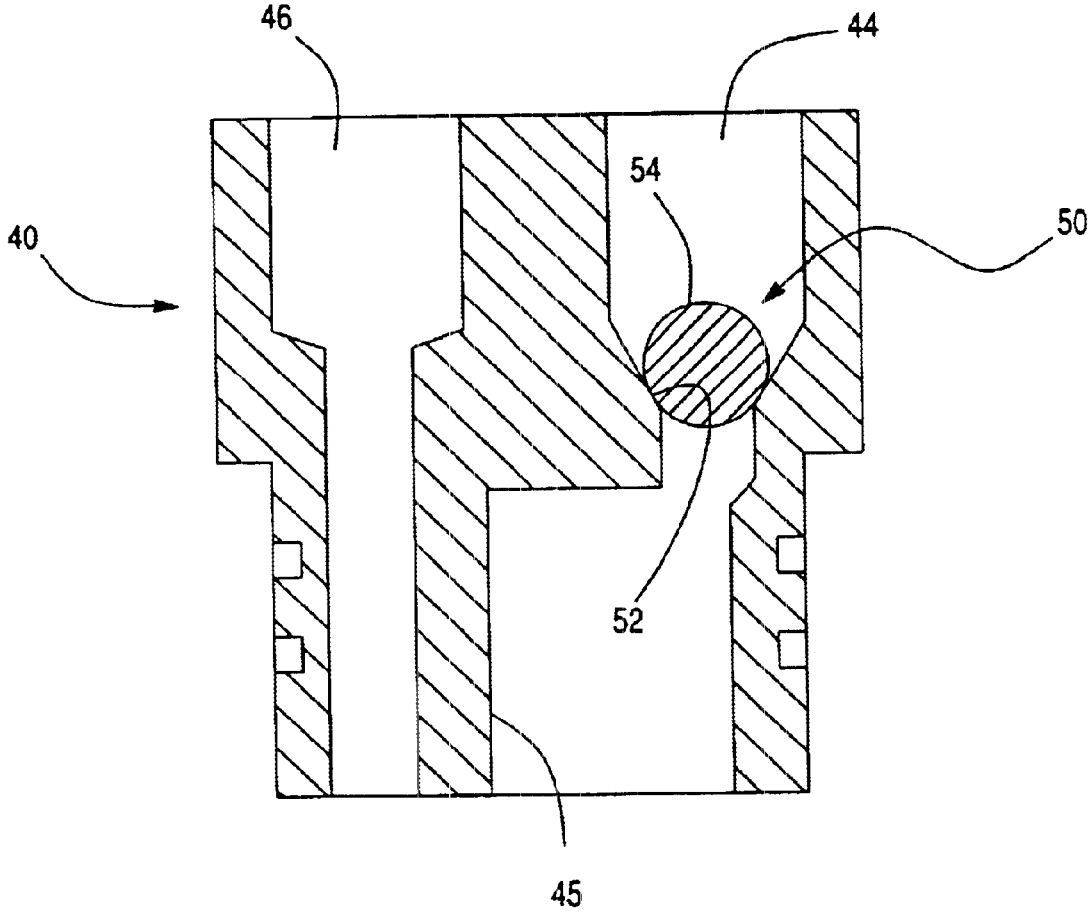
FIG. 4 is a cross-sectional view of a top cap in accordance with the preferred embodiment of the present invention.

The upper end of the pump casing 30 is sealingly closed with a top cap 40 secured to the upper end 35 of the tubular pump casing 30 in any appropriate manner known to those skilled in the art, such as press-fitting. The top cap 40 is sealed to an internal surface of the wall 32 by means of O-rings 42 or other suitable sealing means known to those skilled in the art. The top cap 40, illustrated in detail in FIG. 4, is further provided with an outlet liquid port 44, and a fluid communication port 46. The outlet fitting 14 is affixed to the liquid outlet port 44. Similarly, the fluid fitting 20 is affixed to the fluid communication port 46. The fittings 14 and 20 are identical and may be conventional threaded fittings or any other appropriate fittings well known in the prior art.

Further in accordance with the present invention, the top cap 40 is provided with an outlet check valve 50 for preventing backflow of the pumped liquid through the outlet liquid port 44. The outlet check valve 50 generally includes a valve seat 52, preferably integrally formed within the outlet liquid port 44, and a valve closure member complementary to the valve seat 52. Preferably, as shown in FIGS. 3 and 4, the valve closure member is in the form of a substantially spherical ball member 54. Such an arrangement allows disassembling of the inlet check valve 50 by the user for cleaning when required. It will be appreciated by those skilled in the art that any other appropriate shapes of the valve closure member, such as conical, are within the scope of the present invention.

Secured to the top cap 40 is a top bladder mandrel 55 extending through a bore 45 in the outlet liquid port 44. The top bladder mandrel 55 is provided with an axial communication passage 56 therethrough in fluid communication with the outlet liquid port 44. The top bladder mandrel 55 is preferably threadedly attached to the top cap 40. In this case, the bore 45 of the outlet liquid port 44 is provided with appropriate screw threads. It will be appreciated that the top bladder mandrel 55 may be secured to the top cap 40 in any appropriate manner known to those skilled in the art.

As further illustrated in FIG. 3, the sampling pump 10 also includes a mandrel sealing member 60 disposed within the lower end 34 of the tubular pump casing 30 between the bottom plug 38 and the top cap 40. The mandrel sealing member 60 sealingly engages an inner peripheral surface of the wall 32 by means of O-rings 62, and defines an inlet chamber 48 within the lower end 34 of the casing 30 between the bottom plug 38 and the sealing member 60. As shown in FIG. 3, the groundwater enters the inlet chamber 48 through the inlet openings 39.

Figure 5:
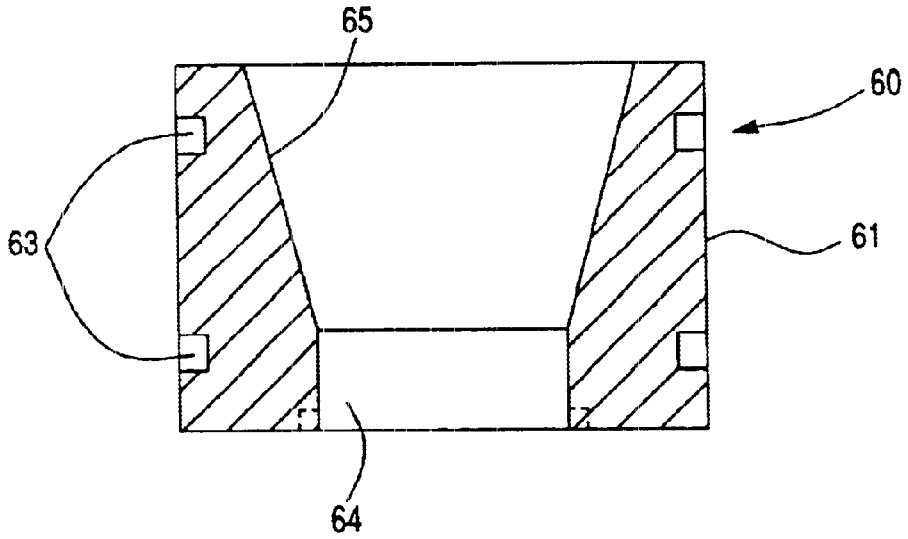
FIG. 5 is a cross-sectional view of a mandrel sealing member in accordance with the preferred embodiment of the present invention.

As illustrated in details in FIG. 5, the mandrel sealing member 60 includes a substantially cylindrical body 61 provided with annular grooves 63 integrally formed on an outer peripheral surface thereof. The annular grooves 63 are adapted to receive the O-rings 62 therein, as shown in FIG. 3. The mandrel sealing member 60 further has a central opening 64 therethrough including a substantially conical sealing surface 65.

Figure 6:
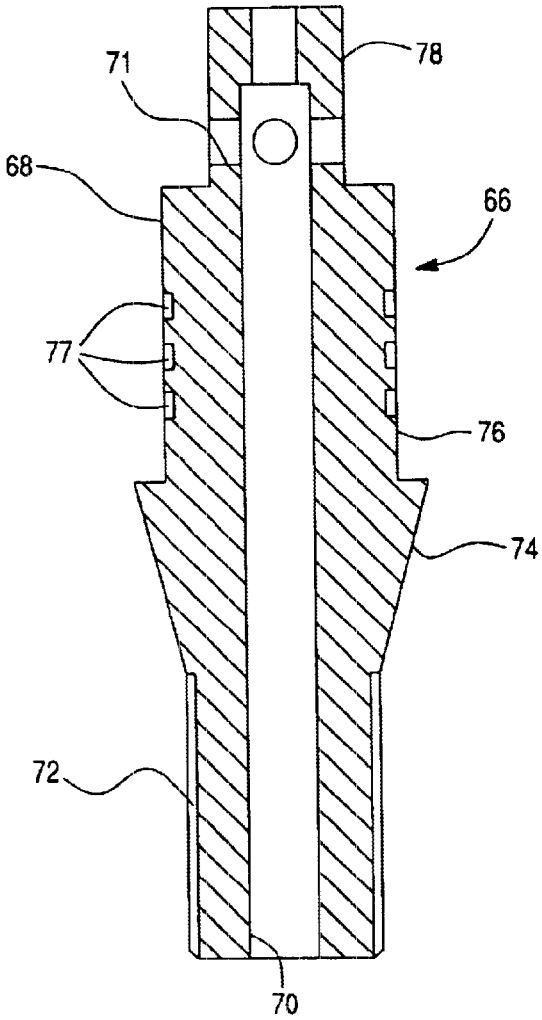
FIG. 6 is a cross-sectional view of a bottom bladder mandrel in accordance with the preferred embodiment of the present invention.

Secured to the mandrel sealing member 60 is a bottom bladder mandrel 66 extending through the central opening 64 therein. Preferably, as illustrated in detail in FIG. 6, the bottom bladder mandrel 66 includes a body 68 provided with an axial communication passage 70 therethrough, a substantially cylindrical threaded end portion 72, a substantially conical sealing surface 74, a substantially cylindrical bladder mounting surface 76 provided with annular grooves 77 are adapted to receive O-rings therein, and a nose portion 78. It will be appreciated that the conical sealing surface 74 is adapted to engage the conical sealing surface 65 of the mandrel sealing member 60, and is substantially complementary thereto. The body 68 of the bottom bladder mandrel 66 further includes a plurality of radial apertures 71 in fluid communication with the axial communication passage 70.

The bottom bladder mandrel 66 is secured to the mandrel sealing member 60 by a nut member 79 threaded onto the end portion 72 of the body 68 of the bottom bladder mandrel 66.

Figure 7:
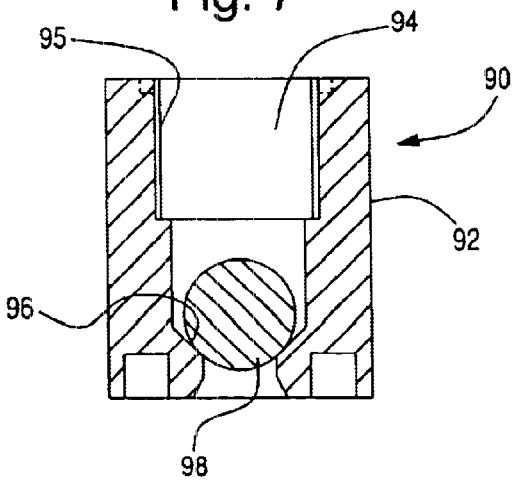
FIG. 7 is a cross-sectional view of an inlet check valve in accordance with the preferred embodiment of the present invention.

Further in accordance with the present invention, secured to the bottom bladder mandrel 66 is an inlet check valve 90 adapted for preventing backflow of the pumped liquid through the an axial communication passage 70 thereof. Preferably, as illustrated in detail in FIG. 7, the inlet check valve 90 includes a body 92 having an axial bore 94 therethrough, a valve seat 96, preferably integrally formed within the axial bore 94, and a valve closure member complementary to the valve seat 96. Preferably, as shown in FIGS. 3 and 7, the valve closure member is in the form of a substantially spherical ball member 98. It will be appreciated by those skilled in the art that any other appropriate shapes of the valve closure member, such as conical, are within the scope of the present invention. Preferably, an upper end portion of the bore 94 is provided with screw threads 95 adapted to threadedly engage complementary threads 72 on the threaded end portion 72 of the bottom bladder mandrel 66, thus removably securing the inlet check valve 90 to the bottom bladder mandrel 66. Such an arrangement allows disassembling of the inlet check valve 90 by the user for cleaning when required. It will be appreciated that the inlet check valve 90 may be secured to the bottom bladder mandrel 66 in any other appropriate manner known in the art, such as press-fitting, adhesive bonding, etc.

The interior of the pump casing 30 is divided and isolated into two chambers by a generally cylindrical flexible bladder 80 having a central portion 81 and two opposite ends 82' and 82". The bladder 80 defines a liquid chamber 84 in its interior and a substantially annular fluid chamber 86 between an exterior of the bladder 80 and an interior wall surface of the pump casing 30. The bladder 80 is sealingly connected to the top bladder mandrel 55 at its upper end 82' by means of O-rings 57 and a band clamp 59, and to the bottom bladder mandrel 66 at its lower end 82" by means of O-rings 75 and a band clamp 73. The band clamps 59 and 73 may be composed of any appropriate materials known to those skilled in the art.

The top bladder mandrel 55 and the bottom bladder mandrel 66 are interconnected by a support member 87. Preferably, the support member 87 is a solid rod made of a plastic material or stainless steel coated with polytetrafluoroethylene (PTFE) marketed under the DuPont Teflon® trademark. In this case, the top bladder mandrel 55 includes a number of radial communication apertures 58 providing the free flow of groundwater liquid between the liquid chamber 84 and the passage 56 in the top bladder mandrel 55. Similarly, the radial apertures 71 in the bottom mandrel 66 provide the free flow of groundwater liquid between the liquid chamber 84 and the passage 70.

Alternatively, the support member 87 may be in the form of a hollow tube provided with a number of apertures spaced at various locations along its longitudinal length in order to allow the free flow of groundwater fluid between the interior of the tube and the remainder of the liquid chamber 84.

As is apparent from the embodiment depicted in FIG. 3, the liquid chamber 84 within the flexible bladder 80 is in fluid communication with the liquid outlet port 44 of the top cap 40 through the communication passage 56 and the apertures 58 in the top bladder mandrel 55 and the outlet check valve 50. Furthermore, the liquid chamber 84 is in fluid communication with the inlet chamber 48 through the passage 70 and the apertures 71 in the top bladder mandrel 55 and the inlet check valve 90. On the other hand, the annular fluid chamber 86 is in fluid communication with the fluid communication port 46 of the top cap 40.

As illustrated in FIG. 3, the bladder 80 is formed with the reduced diameter ends 82' and 82" relative to the central portion 81 thereof. This allows for an increased stroke volume and, therefore, increased efficiency of the pump operation.

As further illustrated in FIG. 3, the liquid inlet apertures 39 in the wall 32 are located substantially between the bottom plug 38 and the mandrel sealing member 60. Preferably, the inlet apertures 39 are located in close proximity to each other forming a limited sampling area. This allows the pump 10 to sample a narrow stratum of liquid in the monitoring well. A mesh screen filter 37, preferably, of inert corrosion resistant material, such as plastic or stainless steel, is disposed within the casing 30 adjacent to the apertures 39 for filtering out solids greater than a predetermined size.

When the pumped liquid, such as groundwater, is flowing through the pump in the direction indicated by flow arrows 88, the groundwater passes through the outlet check valve 50 and through the outlet port 44 to the outlet fitting 14. The outlet check valve 50 in the top cap 40 substantially prevents backflow in the direction opposite that indicated by flow arrows 88. Correspondingly, the inlet cone-shaped check valve 90 prevents backflow of groundwater or other pumped liquid from the liquid chamber 84 through the axial communication passage 70 in the bottom bladder mandrel 66 into the inlet chamber 48.

In operation, the fluid sampling pump 10 of the present invention is actuated by means of actuating gas supplied to the fluid chamber 86 which is alternately and sequentially subjected to positive and negative or reduced pressures. The alternate pressurizing and depressurizing of the actuating gas in the fluid chamber 86 causes the bladder 80 to alternately expand and contract, thus alternately and sequentially decreasing and increasing the volume of the liquid chamber 84. During such increases in volume, the groundwater is drawn from the well 2 into the liquid chamber 84 through the inlet apertures 39 in the casing 30 and the axial communication passage 70 in the bottom bladder mandrel 66. During such decreases in such volume, the groundwater is forced out of the liquid chamber 84 through the passage 56 in the top bladder mandrel 55 and the outlet port 44 in the top cap 40 and is passed through the outlet fitting 14 and the groundwater conduit 16 to be collected in the sample collection vessel 17. The check valves 50 and 90 prevent the water from being discharged through the inlet apertures 39 or drawing in through the outlet port 44.

The capacity of the pump 10 may be changed in different versions of the pump by changing the diameter of the tubular pump casing 30, thereby changing the amount of water drawn in and forced out during the alternate contractions and relaxations of the flexible bladder 80. Preferably, the bladder pumps in accordance with the present invention is manufactured with the outside diameter 1.315". Theoretically, increasing the length of the pump wall 32 and correspondingly increasing the length of the bladder 50 would also increase the stroke volume. However, the longer pumps are subject to hang up in the non-plumb monitoring wells. For this reason, the bladder pumps for well monitoring ought to be designed as short as possible, such as 7.4".

It should be noted that the various components of the pump 10, contacting the pumped liquid, are preferably composed of relatively lightweight and low-cost synthetic materials that will not be corroded when exposed to the groundwater and that will not otherwise affect the composition of the groundwater flowing through the pump. Examples of such materials include stainless steel, rigid polyvinyl chloride (PVC), DELRIN and polytetrafluoroethylene (PTFE) marketed under the DuPont Teflon® trademark. The flexible bladder 80 is preferably composed of a flexible synthetic material that also will not corrode or affect the composition of groundwater flowing therethrough, such as PTFE, or Teflon®. The casing 30 of the pump is preferably made of PVC. The ball members 54 and 98 of the ckeck valves 50 and 90 respectively, are preferably made of PTFE, or Teflon®. One skilled in the art will readily recognize, however, that the various components of the fluid sampling apparatus may be composed of other suitable non-corrosive materials.

Therefore, the novel arrangement of the liquid sampling bladder pump of the present invention as constructed in the above-described embodiments provides simplified field application and easy deployment in non-plumb wells, and allows for obtaining representative samples of groundwater or other liquids.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A bladder-type fluid-actuated liquid pump adapted to be at least partially submerged in a liquid to be pumped, said pump comprising:

a substantially tubular casing adapted to be immersed in the liquid, said casing having an upper end and a lower end;

a liquid inlet provided at said lower end of said tubular casing including at least one intake opening formed in said hollow casing;

a top cap attached to said upper end of said casing, said top cap including a fluid communication port and a liquid outlet port;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet port;

an inlet check valve disposed between said liquid inlet and said liquid chamber for permitting one-way flow of the liquid therethrough from said inlet to said liquid chamber and for preventing back-flow of the liquid from said liquid chamber to said liquid inlet;

an outlet check valve disposed between said liquid outlet port and said liquid chamber for permitting one-way flow of the liquid therethrough from said liquid chamber to said liquid outlet port and for preventing back-flow of the liquid from said liquid outlet port to said liquid chamber;

a flexible bladder separating said fluid chamber from said liquid chamber, said bladder being selectively deformable in response to changes in pressure of the fluid in order to cause the liquid to flow through said liquid chamber from said liquid inlet to said outlet;

a top bladder mandrel secured to said top cap, said top bladder mandrel having a communication passage therethrough for fluidly connecting said liquid chamber to said liquid outlet port in said top cap;

a mandrel sealing member disposed in said lower end of said casing and defining an inlet chamber within said lower end of said casing, said inlet chamber being in fluid communication with said at least one liquid inlet, said mandrel sealing member sealingly separating said fluid chamber from said inlet chamber;

a bottom bladder mandrel secured to said mandrel sealing member, said bottom bladder mandrel having a communication passage therethrough for fluidly connecting said liquid chamber to said inlet chamber; and a support member extending between said top and bottom mandrel inside said bladder, wherein said bladder being sealingly secured to said top bladder mandrel at one end and to said bottom bladder mandrel at the other end, and wherein said liquid chamber is enclosed within said flexible bladder.

2. The bladder-type fluid-actuated liquid pump as defined in claim 1, wherein said bottom bladder mandrel is removably secured to said mandrel sealing member.

3. The bladder-type fluid-actuated liquid pump as defined in claim 1, wherein said inlet check valve is removably secured to said bottom bladder mandrel.

4. The bladder-type fluid-actuated liquid pump as defined in claim 1, wherein said outlet check valve is disposed in said top cap.

5. The bladder-type fluid-actuated liquid pump as defined in claim 4, wherein said outlet check valve is disposed within said liquid outlet port in said top cap.

6. The bladder-type fluid-actuated liquid pump as defined in claim 4, wherein said outlet check valve includes a valve seat formed in said liquid outlet port of said top cap and a complementary valve closure member.

7. The bladder-type fluid-actuated liquid pump as defined in claim 6, wherein said valve closure member is a substantially spherical in shape.

8. The bladder-type fluid-actuated liquid pump as defined in claim 6, wherein said valve closure member is made of one of polytetrafluoroethylene and plastic material.

9. The bladder-type fluid-actuated liquid pump as defined in claim 1, wherein said inlet check valve includes a valve body secured to said bottom bladder mandrel, a valve seat formed in said valve body and a complementary valve closure member.

10. The bladder-type fluid-actuated liquid pump as defined in claim 9, wherein said valve closure member is a substantially spherical in shape.

11. The bladder-type fluid-actuated liquid pump as defined in claim 9, wherein said valve closure member is made of one of polytetrafluoroethylene and plastic material.

12. The bladder-type fluid-actuated liquid pump as defined in claim 1, wherein said inlet check valve and said outlet check valve are both ball-shaped check valves.

13. The bladder-type fluid-actuated liquid pump as defined in claim 1, wherein said bottom bladder mandrel has a substantially conical sealing surface sealingly engaging a substantially complementary conical sealing surface provided on said mandrel sealing member.

14. The bladder-type fluid-actuated liquid pump as defined in claim 1, wherein said bottom bladder mandrel is removably secured to said mandrel sealing member by means of a nut member threaded onto said bottom bladder mandrel.

15. The bladder-type fluid-actuated liquid pump as defined in claim 1, wherein said inlet check valve is secured to said bottom bladder mandrel.

16. The bladder-type fluid-actuated liquid pump as defined in claim 1, wherein said top bladder mandrel is removably secured to said top cap.

17. The bladder-type fluid-actuated liquid pump as defined in claim 1, further including a screen filter disposed adjacent to said intake opening to filter the liquid flowing therethrough.

18. The bladder-type fluid-actuated liquid pump as defined in claim 1, wherein said bladder having a central portion and opposite ends, and said central portion having a larger diameter than said ends.

19. The bladder-type fluid-actuated liquid pump as defined in claim 1, wherein said flexible bladder being made of polytetrafluoroethylene.

20. The bladder-type fluid-actuated liquid pump as defined in claim 1, wherein said tubular casing being made of plastic material.

21. The bladder-type fluid-actuated liquid pump as defined in claim 20, wherein said plastic material is polyvinyl chloride.

22. The bladder-type fluid-actuated liquid pump as defined in claim 1, wherein said support member being a solid rod and each of said top and bottom mandrels being provided with at least one aperture in order to allow flow of the liquid between said communication passages in said mandrels and said liquid chamber.

23. The bladder-type fluid-actuated liquid pump as defined in claim 22, wherein said solid rod being coated with polytetrafluoroethylene.

24. A bladder-type fluid-actuated liquid pump adapted to be at least partially submerged in a liquid to be pumped, said pump comprising:

a substantially tubular casing adapted to be immersed in the liquid, said casing having an upper end and a lower end;

at least one liquid inlet provided at said lower end of said tubular casing;

a top cap attached to said upper end of said casing, said top cap including a fluid communication port and a liquid outlet port;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet port;

an inlet check valve disposed between said liquid inlet and said liquid chamber for permitting one-way flow of the liquid therethrough from said inlet to said liquid chamber and for preventing back-flow of the liquid from said liquid chamber to said liquid inlet;

an outlet check valve disposed between said liquid outlet port and said liquid chamber for permitting one-way flow of the liquid therethrough from said liquid chamber to said liquid outlet port and for preventing back-flow of the liquid from said liquid outlet port to said liquid chamber;

a flexible bladder separating said fluid chamber from said liquid chamber, said bladder being selectively deformable in response to changes in pressure of the fluid in order to cause the liquid to flow through said liquid chamber from said liquid inlet to said outlet;

a top bladder mandrel secured to said top cap, said top bladder mandrel having a communication passage therethrough for fluidly connecting said liquid chamber to said liquid outlet port in said top cap;

a mandrel sealing member disposed in said lower end of said casing and defining an inlet chamber within said lower end of said casing, said inlet chamber being in fluid communication with said at least one liquid inlet, said mandrel sealing member sealingly separating said fluid chamber from said inlet chamber;

a bottom bladder mandrel secured to said mandrel sealing member, said bottom bladder mandrel having a communication passage therethrough for fluidly connecting said liquid chamber to said inlet chamber, said bottom bladder mandrel having a substantially conical sealing surface sealingly engaging a substantially complementary conical sealing surface provided on said mandrel sealing member; and a support member extending between said top and bottom mandrel inside said bladder, wherein said bladder being sealingly secured to said top bladder mandrel at one end and to said bottom bladder mandrel at the other end, and wherein said liquid chamber is enclosed within said flexible bladder.

25. A bladder-type fluid-actuated liquid pump adapted to be at least partially submerged in a liquid to be pumped, said pump comprising:

a substantially tubular casing adapted to be immersed in the liquid, said casing having an upper end and a lower end;

at least one liquid inlet provided at said lower end of said tubular casing;

a top cap attached to said upper end of said casing, said top cap including a fluid communication port and a liquid outlet port;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet port;

an inlet check valve disposed between said liquid inlet and said liquid chamber for permitting one-way flow of the liquid therethrough from said inlet to said liquid chamber and for preventing back-flow of the liquid from said liquid chamber to said liquid inlet;

an outlet check valve disposed between said liquid outlet port and said liquid chamber for permitting one-way flow of the liquid therethrough from said liquid chamber to said liquid outlet port and for preventing back-flow of the liquid from said liquid outlet port to said liquid chamber;

a flexible bladder separating said fluid chamber from said liquid chamber, said bladder being selectively deformable in response to changes in pressure of the fluid in order to cause the liquid to flow through said liquid chamber from said liquid inlet to said outlet;

a top bladder mandrel secured to said top cap, said top bladder mandrel having a communication passage therethrough for fluidly connecting said liquid chamber to said liquid outlet port in said top cap;

a mandrel sealing member disposed in said lower end of said casing and defining an inlet chamber within said lower end of said casing, said inlet chamber being in fluid communication with said at least one liquid inlet, said mandrel sealing member sealingly separating said fluid chamber from said inlet chamber;

a bottom bladder mandrel secured to said mandrel sealing member, said bottom bladder mandrel having a communication passage therethrough for fluidly connecting said liquid chamber to said inlet chamber, said bottom bladder mandrel removably secured to said mandrel sealing member by means of a nut member threaded onto said bottom bladder mandrel; and a support member extending between said top and bottom mandrel inside said bladder, wherein said bladder being sealingly secured to said top bladder mandrel at one end and to said bottom bladder mandrel at the other end, and wherein said liquid chamber is enclosed within said flexible bladder.

26. A bladder-type fluid-actuated liquid pump adapted to be at least partially submerged in a liquid to be pumped, said pump comprising:

a substantially tubular casing adapted to be immersed in the liquid, said casing having an upper end and a lower end;

at least one liquid inlet provided at said lower end of said tubular casing;

a top cap attached to said upper end of said casing, said top cap including a fluid communication port and a liquid outlet port;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet port;

an inlet check valve disposed between said liquid inlet and said liquid chamber for permitting one-way flow of the liquid therethrough from said inlet to said liquid chamber and for preventing back-flow of the liquid from said liquid chamber to said liquid inlet;

an outlet check valve disposed between said liquid outlet port and said liquid chamber for permitting one-way flow of the liquid therethrough from said liquid chamber to said liquid outlet port and for preventing back-flow of the liquid from said liquid outlet port to said liquid chamber;

a flexible bladder separating said fluid chamber from said liquid chamber, said bladder being selectively deformable in response to changes in pressure of the fluid in order to cause the liquid to flow through said liquid chamber from said liquid inlet to said outlet, said bladder having a central portion and opposite ends, said central portion of said bladder having a larger diameter than said ends;

a top bladder mandrel secured to said top cap, said top bladder mandrel having a communication passage therethrough for fluidly connecting said liquid chamber to said liquid outlet port in said top cap;

a mandrel sealing member disposed in said lower end of said casing and defining an inlet chamber within said lower end of said casing, said inlet chamber being in fluid communication with said at least one liquid inlet, said mandrel sealing member sealingly separating said fluid chamber from said inlet chamber;

a bottom bladder mandrel secured to said mandrel sealing member, said bottom bladder mandrel having a communication passage therethrough for fluidly connecting said liquid chamber to said inlet chamber; and a support member extending between said top and bottom mandrel inside said bladder, wherein said bladder being sealingly secured to said top bladder mandrel at one end and to said bottom bladder mandrel at the other end, and wherein said liquid chamber is enclosed within said flexible bladder.

27. A bladder-type fluid-actuated liquid pump adapted to be at least partially submerged in a liquid to be pumped, said pump comprising:

a substantially tubular casing adapted to be immersed in the liquid, said casing having an upper end and a lower end;

at least one liquid inlet provided at said lower end of said tubular casing;

a top cap attached to said upper end of said casing, said top cap including a fluid communication port and a liquid outlet port;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet port;

an inlet check valve disposed between said liquid inlet and said liquid chamber for permitting one-way flow of the liquid therethrough from said inlet to said liquid chamber and for preventing back-flow of the liquid from said liquid chamber to said liquid inlet;

an outlet check valve disposed between said liquid outlet port and said liquid chamber for permitting one-way flow of the liquid therethrough from said liquid chamber to said liquid outlet port and for preventing back-flow of the liquid from said liquid outlet port to said liquid chamber;

a flexible bladder separating said fluid chamber from said liquid chamber, said bladder being selectively deformable in response to changes in pressure of the fluid in order to cause the liquid to flow through said liquid chamber from said liquid inlet to said outlet;

a top bladder mandrel secured to said top cap, said top bladder mandrel having a communication passage therethrough for fluidly connecting said liquid chamber to said liquid outlet port in said top cap;

a mandrel sealing member disposed in said lower end of said casing and defining an inlet chamber within said lower end of said casing, said inlet chamber being in fluid communication with said at least one liquid inlet, said mandrel sealing member sealingly separating said fluid chamber from said inlet chamber;

a bottom bladder mandrel secured to said mandrel sealing member, said bottom bladder mandrel having a communication passage therethrough for fluidly connecting said liquid chamber to said inlet chamber; and a support member extending between said top and bottom mandrel inside said bladder, wherein said bladder being sealingly secured to said top bladder mandrel at one end and to said bottom bladder mandrel at the other end, wherein said liquid chamber is enclosed within said flexible bladder, and wherein said support member being a solid rod and each of said top and bottom mandrels being provided with at least one aperture in order to allow flow of the liquid between said communication passages in said mandrels and said liquid chamber.

* * * * *